US008338727B2

(12) United States Patent
Wolfe

(10) Patent No.: US 8,338,727 B2
(45) Date of Patent: Dec. 25, 2012

(54) INTERPOLE COUPLING SYSTEM

(75) Inventor: Daniel J. Wolfe, Trafford, PA (US)

(73) Assignee: ABB Technology AG, Zurich (CH)

( * ) Notice: Subject to any disclaimer, the term of this patent is extended or adjusted under 35 U.S.C. 154(b) by 493 days.

(21) Appl. No.: 12/758,829

(22) Filed: Apr. 13, 2010

(65) Prior Publication Data

US 2010/0270136 A1 Oct. 28, 2010

Related U.S. Application Data

(60) Provisional application No. 61/171,696, filed on Apr. 22, 2009.

(51) Int. Cl.
*H01H 9/00* (2006.01)

(52) U.S. Cl. ..... 200/17 R

(58) Field of Classification Search ..... 200/17 R, 200/48 R, 49, 500; 218/7, 9, 14, 120, 153, 218/154

See application file for complete search history.

(56) References Cited

U.S. PATENT DOCUMENTS 1,819,207 A * 8/1931 Slepian ..... 218/149
3,214,550 A * 10/1965 Easley ..... 218/58
3,284,602 A * 11/1966 Friedrich et al. ..... 218/44
3,291,949 A * 12/1966 Cromer ..... 218/81
3,590,192 A * 6/1971 Bould et al. ..... 200/400
3,596,028 A * 7/1971 Kane et al. ..... 218/84
3,624,329 A * 11/1971 Fischer et al. ..... 335/191
4,123,635 A 10/1978 Rostron
5,128,502 A 7/1992 Hux
5,569,891 A 10/1996 Freeman et al.
5,864,942 A 2/1999 Luzzi
7,210,974 B1 5/2007 Meyer

* cited by examiner

*Primary Examiner* — Edwin A. Leon
(74) *Attorney, Agent, or Firm* — Michael Charles Prewitt

(57) ABSTRACT

A circuit breaker includes a plurality of pole assemblies, each having a movable contact and a stationary contact. A bellcrank assembly is associated with each pole assembly. Each bellcrank assembly includes a bellcrank lever including a cylindrical body and at least one radially extending arm. The radially extending arm is mechanically interrelated with the movable contact so that rotation of the bellcrank lever selectively causes the movable contact to engage or disengage the stationary contact. At least one of the bellcrank lever radially extending arms is relatively more flexible than the other bellcrank lever radially extending arms.

17 Claims, 17 Drawing Sheets

INTERPOLE COUPLING SYSTEM

This application claims priority to U.S. Provisional Application No. 61/171,696 titled Interpole Coupling System and filed on Apr. 22, 2009, the contents of which are hereby incorporated by reference in their entirety.

BACKGROUND

Circuit breakers are commonly found in substations and are operable to selectively open and close electrical connections. With Reference now to FIGS. 1 and 2, a prior art circuit breaker is shown and generally indicated with the numeral 10. Circuit breaker 10 is a three phase circuit breaker, and thus includes three pole assemblies 12*a*, 12*b* and 12*c*. Each pole assembly includes a first electrical conductor 14 carried in a first bushing 16 and a second electrical conductor 18 carried in a second bushing 20. As is known in the art, electrical power lines are coupled to first and second electrical conductors 14 and 18, and breaker 10 selectively opens or closes the electrical connection therebetween.

With reference to FIGS. 3 and 4, a simplified view of the interior of pole assembly 12 is shown, wherein first electrical conductor 14 is electrically connected to a stationary contact 22 which is immovably secured within pole assembly 12. Second electrical conductor 18 is electrically connected to a movable contact 24 which is carried within pole assembly 12 in a manner allowing longitudinal movement therein. Thus, in a first position, the movable contact 24 may be positioned to break the electrical connection between first electrical conductor 14 and second electrical conductor 18 (See FIG. 3). In a second position, the movable contact 24 may be brought into contact with stationary contact 22 to electrically connect the first electrical conductor 14 and the second electrical conductor 18 (see FIG. 4). The interior space of pole assemblies 12 are sealed and generally adapted to minimize arcing between stationary contact 22 and movable contact 24. The interior volume of pole assembly 12 may be filled with dielectric mediums that include $SF_6$, dry air, dry nitrogen, $CO_2$ or oil. Alternatively, a vacuum-type interrupter could be employed within the tank volume surrounded by dielectric mediums mentioned.

Ganged circuit breakers (all three poles actuated simultaneously) are a common configuration for high voltage breakers. One of the more common methods of concurrently actuating the three phases employs a plurality of bell crank assemblies 26, interconnected by a plurality of shafts. Each movable contact 24, and thus each pole 12*a*, 12*b*, and 12*c* includes an associated bell crank assembly 26*a*, 26*b* and 26*c*.

With reference to FIG. 5, each bell crank assembly 26 includes a housing 30 that partially encloses a stub shaft 32 rotatably carried by a pair of bearings 34. A pair of circumferentially extending gas seals 36 are positioned axially inward of each bearing 34, prevent the escape of the dielectric medium from within the pole assembly interior. A dust or weather seal 38 is positioned axially outward of each bearing 34 and prevents contaminates from fouling bearings 34.

Each stub shaft 32 carries, and is rotatably coupled to, a bell crank lever 40. Bell crank lever 40 includes a circular hole 42 that receives stub shaft 32 and includes ribbing or other features that engage a matching ribbed or keyed portion 44 of stub shaft 32. The bell crank lever 40 includes arms 45 that extend radially away from stub shaft 32 and are pivotally secured to a push rod 46 that is mechanically interconnected to the moving contact 24 inside the corresponding pole assembly 12. Thus, in this manner, when stub shaft 32 rotates, it causes bell crank lever 40 to move in an arcing motion, which causes push rod 46 to move inwardly or outwardly, thereby causing moving contact 24 to engage or disengage the electrical connection inside the associated pole assembly 12.

Each bell crank assembly 26 is mechanically interconnected so that all three pole assemblies 12 are actuated at the same time by a single actuating mechanism 48 (see FIG. 1). Thus, a first transfer shaft 50 extends between, and interconnects the stub shafts 32 of bell crank assemblies 26*a* and 26*b*. Likewise, a second transfer shaft 52 extends between, and interconnects the stub shafts 32 of bell crank assemblies 26*b* and 26*c*. In this manner stub shafts 32 and transfer shafts 50 and 52 rotate in unison when a rotative force is applied to any one of the stub or transfer shafts.

Though the above discussed circuit breaker design performs in an adequate manner, improved performance is desirable. In particular, improved synchronization between the three phases of the breaker is desirable. Improved synchronization improves overall system performance, helps prevent related equipment failure, and can lower manufacturing costs.

Thus there is a need in the art for a circuit breaker with improved actuation synchronization of the movable contacts within the three pole assemblies.

SUMMARY OF THE INVENTION

According to one aspect of the present invention, a circuit breaker is provided including a plurality of pole assemblies, each pole assembly including a movable contact and a stationary contact. A bellcrank assembly is associated with each pole assembly. Each bellcrank assembly includes a bellcrank lever including a cylindrical body and at least one radially extending arm. The radially extending arm is mechanically interrelated with the movable contact so that rotation of the bellcrank lever selectively causes the movable contact to engage or disengage the stationary contact. At least one of the bellcrank lever radially extending arms is relatively more flexible than another of the bellcrank lever radially extending arms.

According to another aspect of the present invention, a bellcrank arrangement is provided for a circuit breaker having an actuator and a plurality of poles, each pole having movable and stationary contacts. The bellcrank arrangement includes a central bellcrank assembly and a first and second outer bellcrank assemblies positioned on opposed sides of the central bellcrank assembly. Each bellcrank assembly is associated with one of the poles and includes a bellcrank lever having a cylindrical body portion having an axially extending bore. The bellcrank lever includes at least one lever arm extending radially away from the cylindrical body portion. A transfer shaft is rotatively coupled to, and received in, the axially extending bore of the bellcrank lever of each of the central, first and second bellcrank assemblies. The movable contact of each pole is mechanically interconnected to the lever arm of the associated bellcrank assembly so that rotation of the bellcrank lever causes the moveable contact to selectively engage or disengage from the stationary contact.

DETAILED DESCRIPTION OF THE INVENTION

Improved pole synchronization may be achieved by taking into account the flexible deformation and that occurs when forces are applied to the system. Also, other factors must be considered, such as looseness in the coupling points between the various system linkages. The present invention achieves improved synchronization by minimizing and compensating for flex and looseness in the various system elements.

Figure 6:
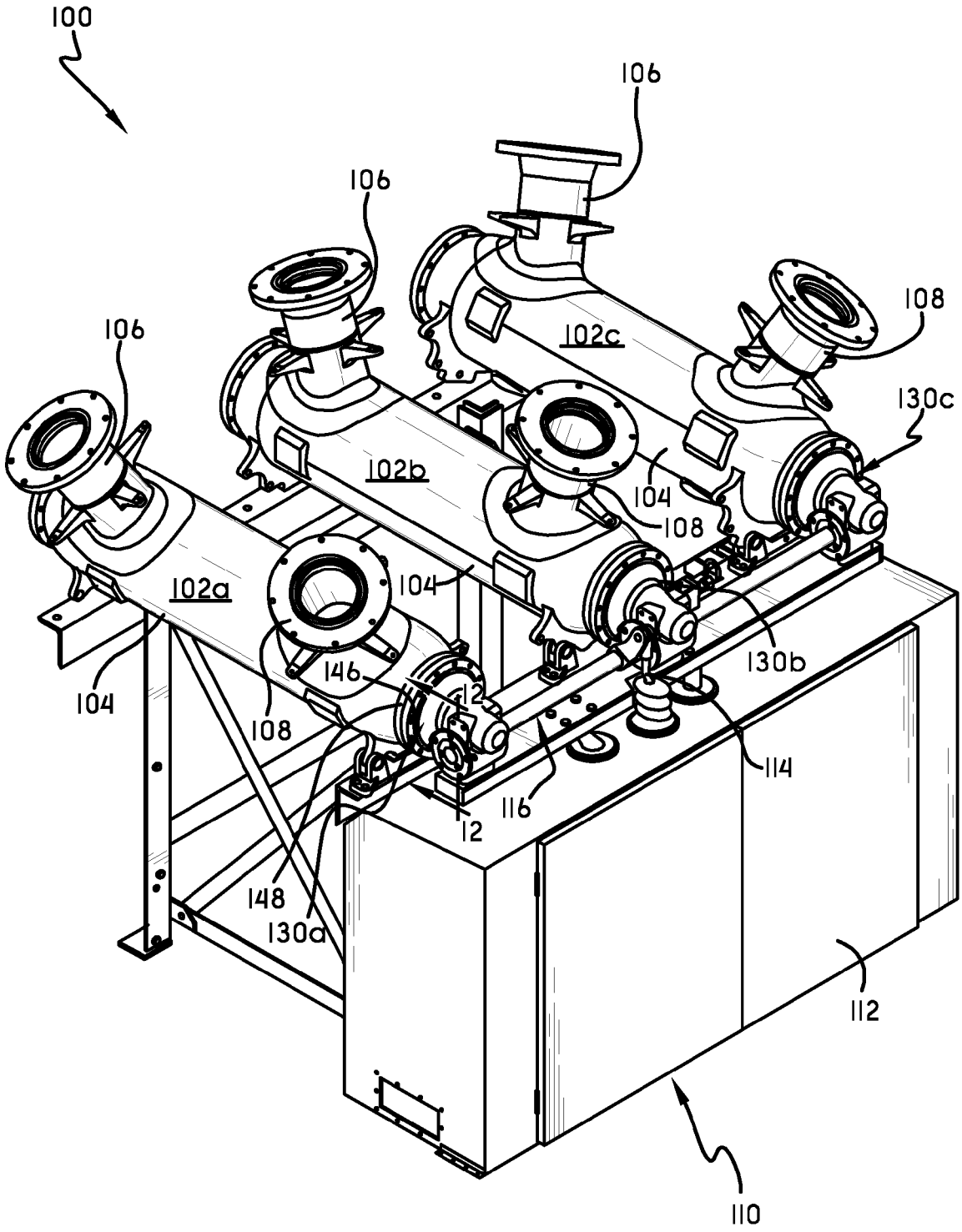
FIG. 6 is an isometric view of a circuit breaker according to the present invention.
Figure 7:
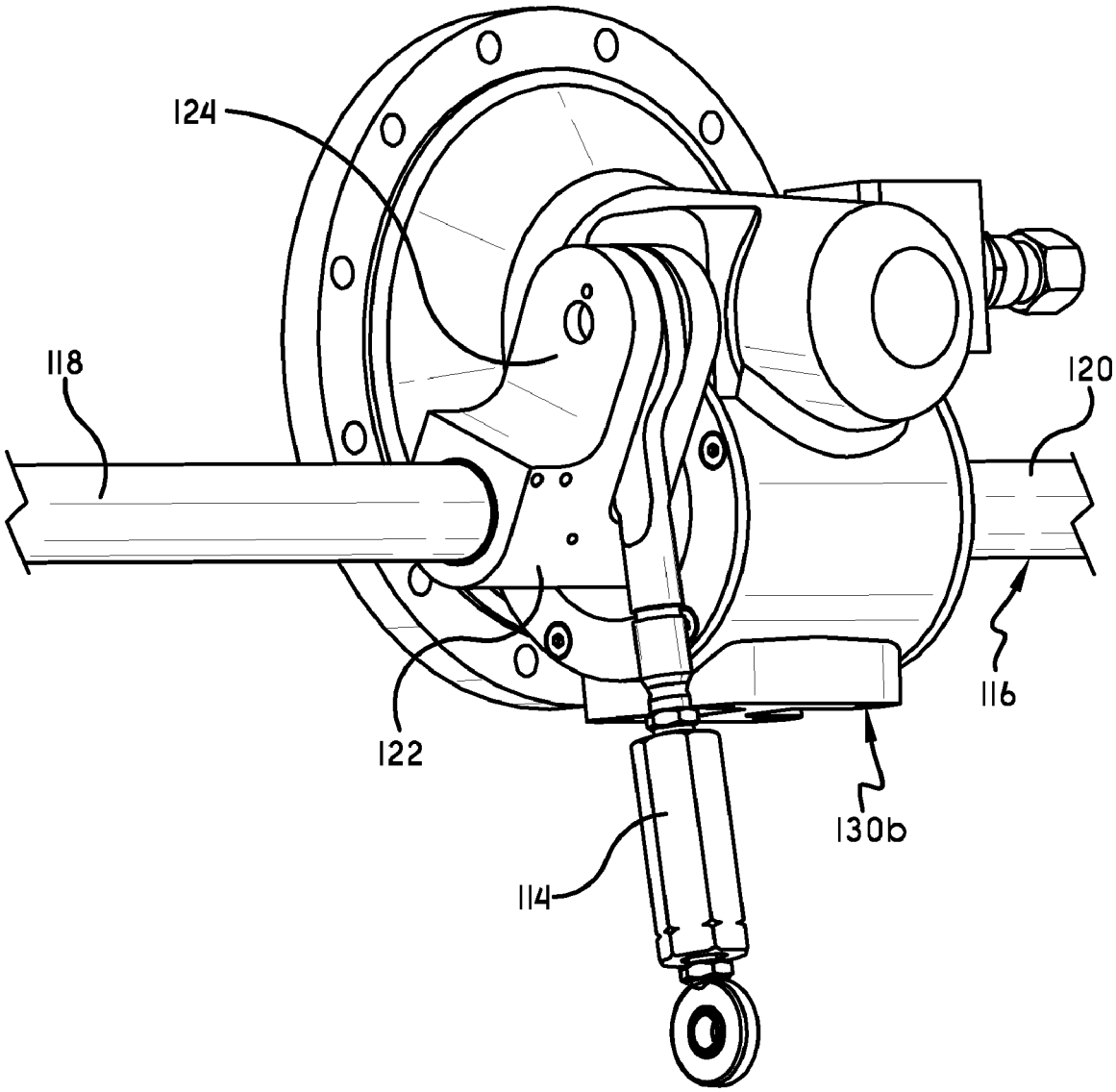
FIG. 7 is an enlarged isometric view of the center bellcrank assembly and transfer shaft assembly according the present invention.

With reference now to FIGS. 6 and 7, a circuit breaker assembly according to the present invention is shown and generally indicated by the numeral 100. Circuit breaker 100 is a three phase circuit breaker, and thus includes three pole assemblies 102*a*, 102*b* and 102*c*. The internal configuration of pole assemblies 102 are generally similar to pole assemblies 12 discussed above, and thus include stationary and movable contacts 22 and 24 that are electrically connected to first and second electrical conductors 14 and 18. A main body 104 is generally tubular and includes a first and second tank nozzle 106 and 108 extending upwardly therefrom. Tank nozzles 106 and 108 accept bushing assemblies (not shown) that include an insulator and electrical conductor. First tank 106 supports first electrical conductor 14 and second bushing 108 supports second electrical conductor 18. When installed, electrical power lines are coupled to the first and second electrical conductors. In this manner, longitudinal movement of movable contact 24 causes the electrical connection between first and second electrical conductor 14 and 18 to be selectively opened or closed.

The actuating force for circuit breaker 100 is provided by an electrically controlled actuating mechanism (not shown). The actuating mechanism may be remotely controlled by substation instrumentation that senses a fault in the system and transmits a control signal to the breaker, which then actuates the method of mechanism actuation. A plurality of types of actuating mechanisms may be used in circuit breaker 100. Actuating mechanisms may be categorized by the method of long-term energy storage and energy transfer. These include electrical energy storage (capacitive) using magnetic (solenoid) or motor energy transfer methods. Pneumatic or spring energy storage with pneumatic/mechanical or hydraulic/mechanical energy transfer methods. The actuating mechanism is carried within and protected by an enclosure 112. The actuating mechanism includes an actuating rod 114 that extends upwardly out of enclosure 112. As will be discussed in greater detail below, the actuating rod 114 of the actuating mechanism is selectively moved upwardly or downwardly to cause breaker 100 to open or close.

The actuating mechanism imparts a moment force on a transfer shaft assembly 116. According to the present embodiment, transfer shaft assembly 116 includes a first transfer shaft 118, axially aligned with, and rotatably coupled to, a second transfer shaft 120. However, it should be appreciated that transfer shaft assembly 116 may be comprised of a single, unified shaft.

Figure 8:
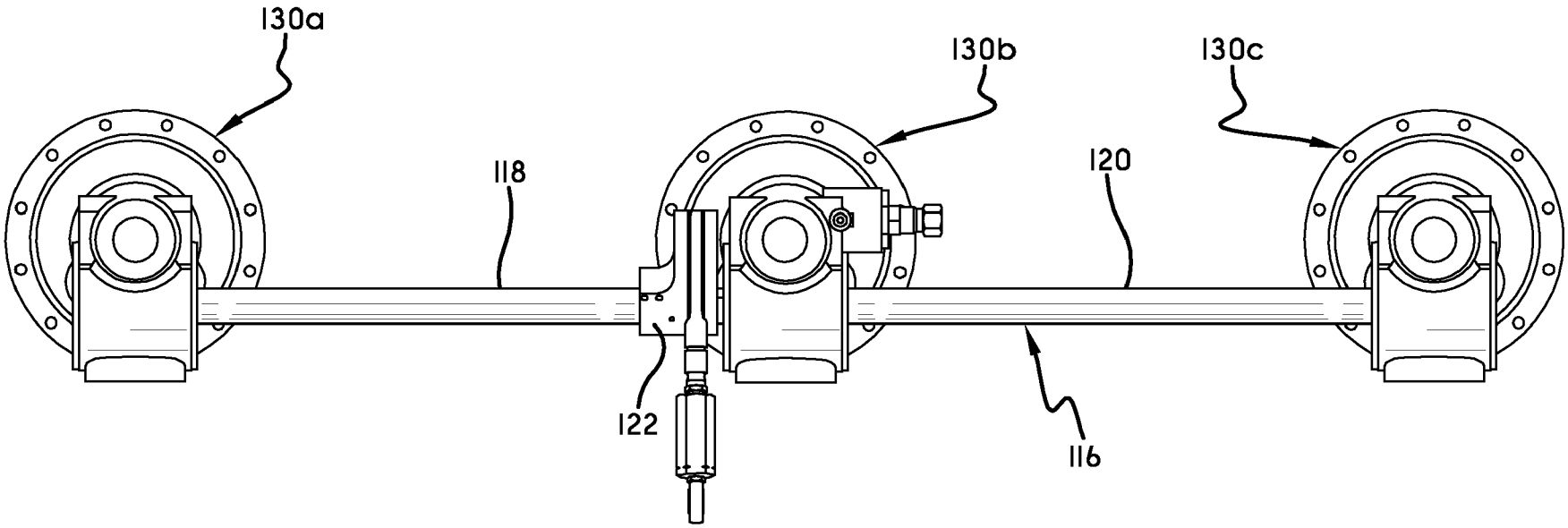
FIG. 8 is a front view of the bellcrank and transfer shaft assemblies according to the present invention.
Figure 13:
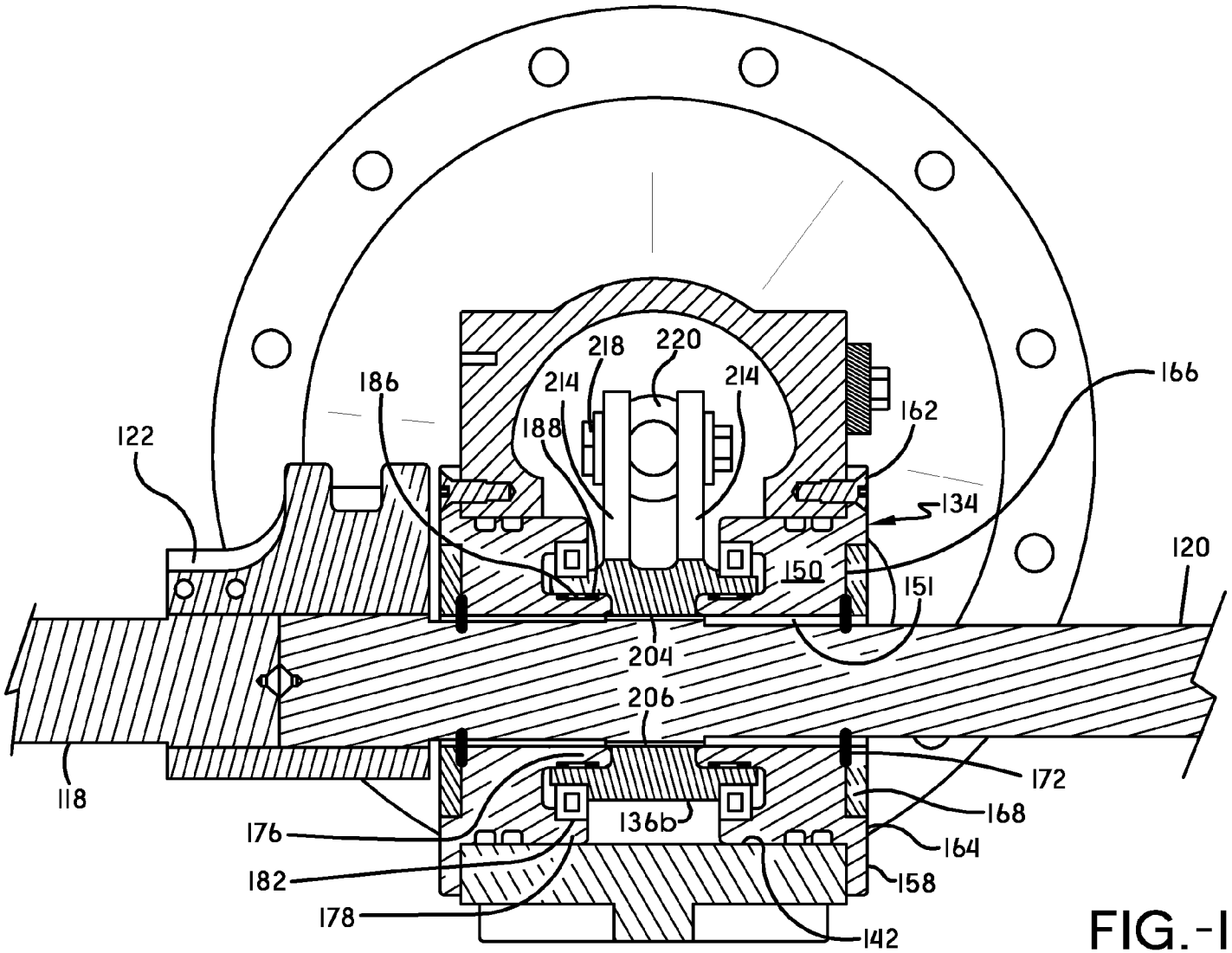
FIG. 13 is an enlarged view of the center bellcrank assembly of FIG. 12.
Figure 14:
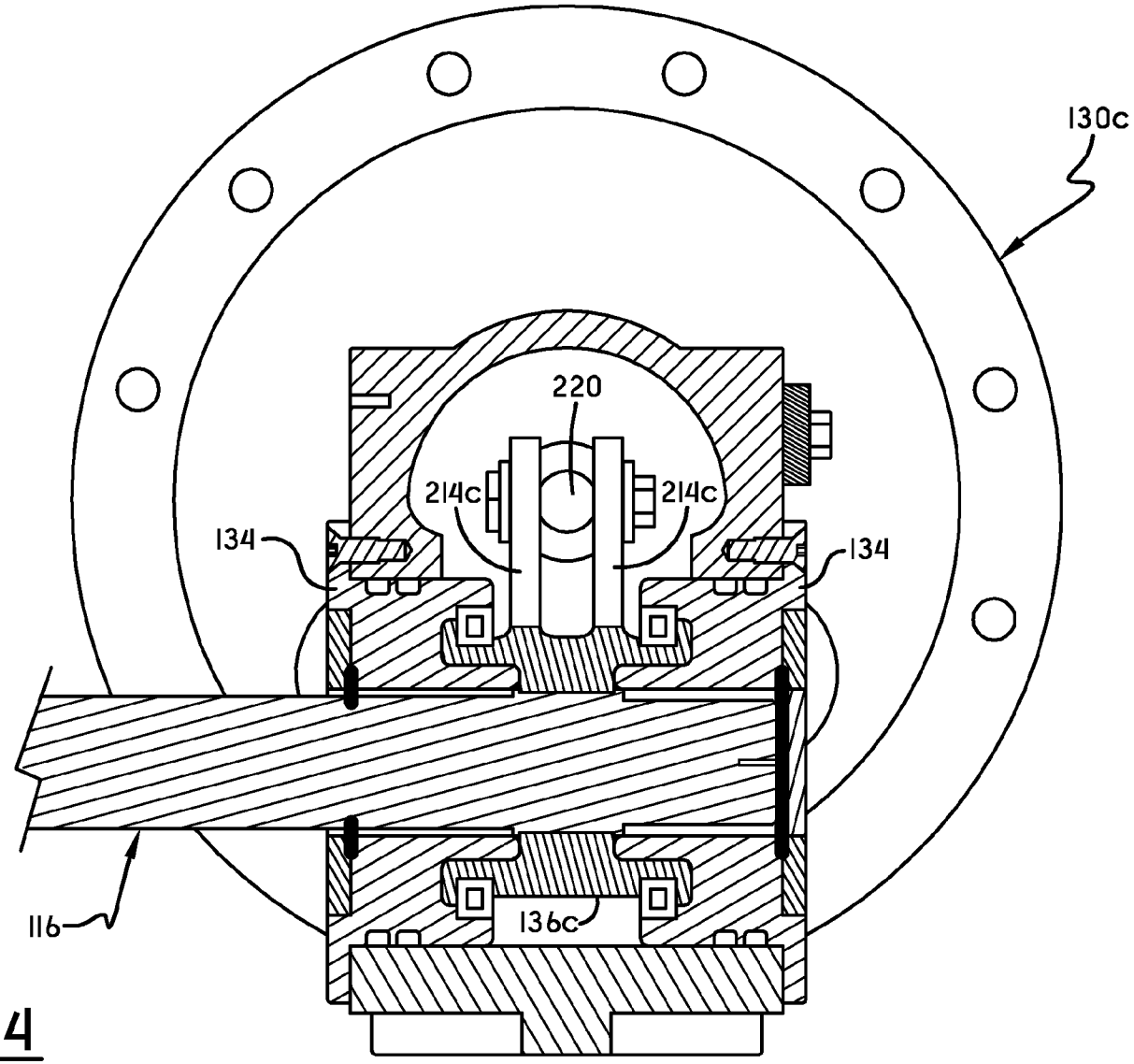
FIG. 14 is an enlarged view of the outer bellcrank assembly of FIG. 12.

A sleeve 122 is received around, and coupled to transfer shaft assembly 116. As shown in FIGS. 7, 8 and 13, sleeve 122 may be positioned over the intersection point of first transfer shaft 118 and second transfer shaft 120. According to this embodiment, sleeve 122 may function to couple first transfer shaft 118 to second transfer shaft 120. Sleeve 122 includes a pair of radially extending arms 124. At a point radially spaced from transfer shaft assembly 116, actuating rod 114 is pivotally secured to radially extending arms 124. In this manner, the generally upward or downward movement of actuating rod 114 is translated into clockwise or counterclockwise rotation of transfer shaft assembly 112.

It should be appreciated that, though the present embodiment discloses an actuating rod moved vertically upward or downward to cause rotation of transfer shaft assembly 116, other means for causing rotation of transfer shaft assembly 116 may be employed. For example, rotating force may be applied via a gear system or the like.

Transfer shaft assembly 116 spans between three bellcrank assemblies 130*a*, 130*b* and 130*c*, associated with pole assemblies 102*a*, 102*b* and 102*c* respectively. Each bellcrank assembly 130 includes a housing 132, a pair of support inserts 134, and a bellcrank lever 136 (See FIGS. 9 and 10). As will be discussed below in greater detail, it should be appreciated that, though the construction of each bellcrank assembly 130 is substantially similar, the bellcrank lever 136*b* in bellcrank assembly 130*b* (the center bellcrank assembly) is configured differently than the bellcrank levers 136*a* and 136*c* in bellcrank assemblies 130*a* and 130*c*.

Figure 9:
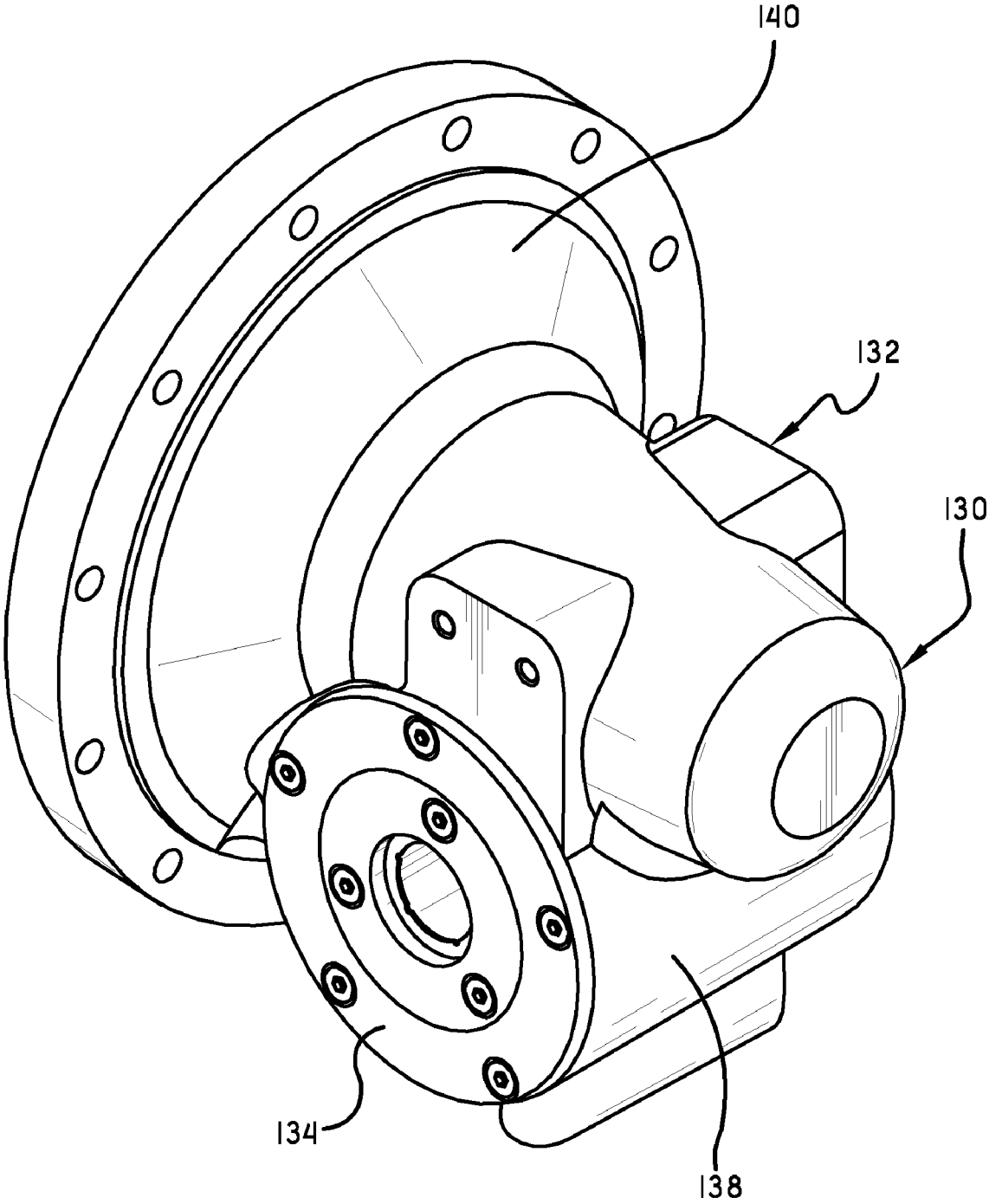
FIG. 9 is an enlarged isometric view of the bellcrank assembly.
Figure 10:
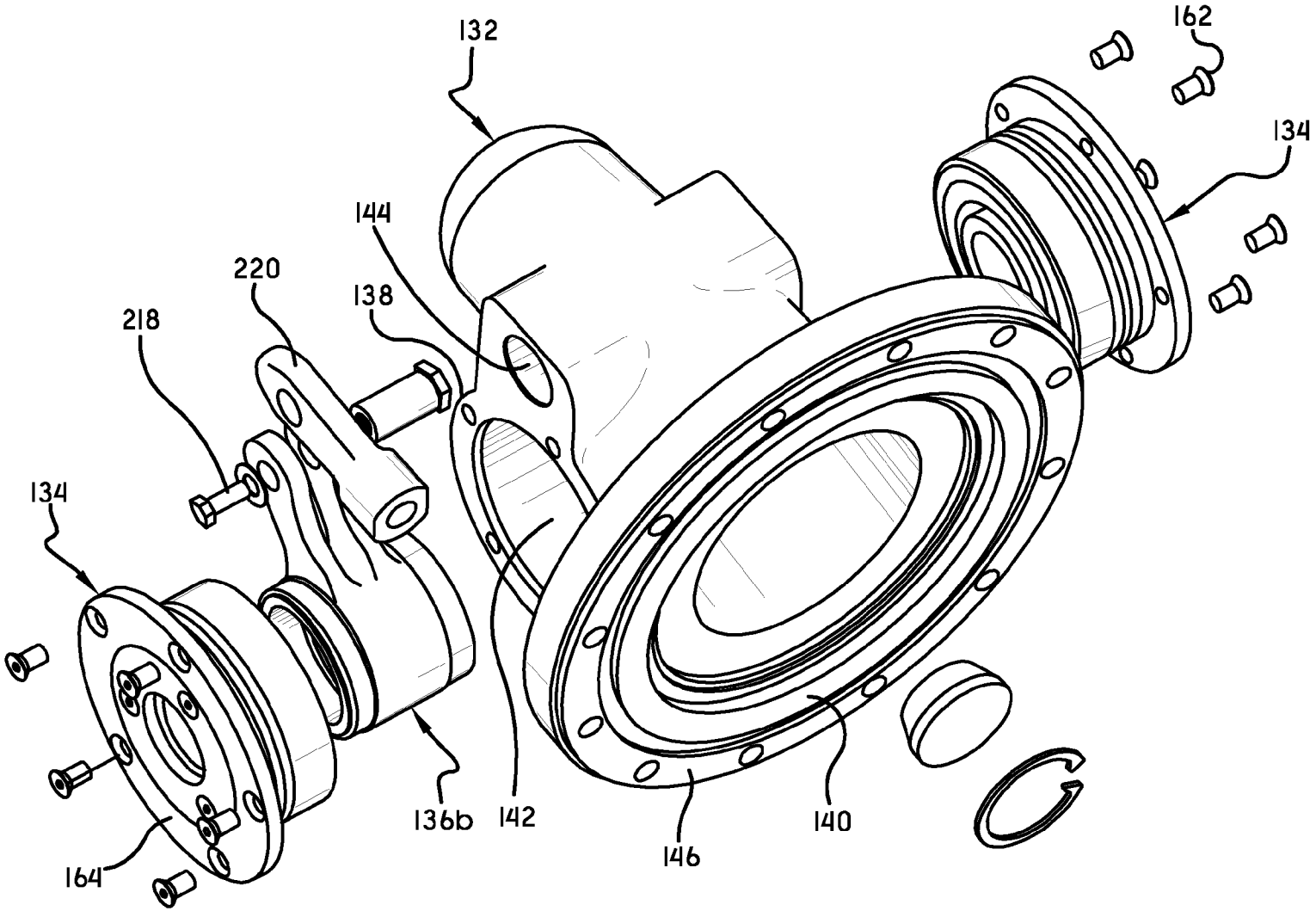
FIG. 10 is an exploded view of the bellcrank assembly.

With reference to FIGS. 9 and 10, housing 132 includes a generally cylindrical portion 138 and a generally horn-shaped portion 140. A bore 142 is defined within cylindrical portion 138 that, as will be described later in greater detail, receives inserts 134, bellcrank 136 and transfer shaft assembly 116 therein. Housing 132 further includes a port 144 that may used to add or remove dielectric medium from pole assemblies 102.

Horn shaped portion 140 defines an interior volume that merges with, and is thus under the same atmospheric conditions as, the internal volume of pole assembly 102. Horn shaped portion 140 forms a flange 146 that is secured to a matching flange 148 on pole assembly 102 (See FIG. 6). One or more seals (not shown) may be positioned between flanges 146 and 148. In this manner bellcrank assembly 130 is coupled to one end of pole assembly 102 in an air-tight manner.

Figure 11:
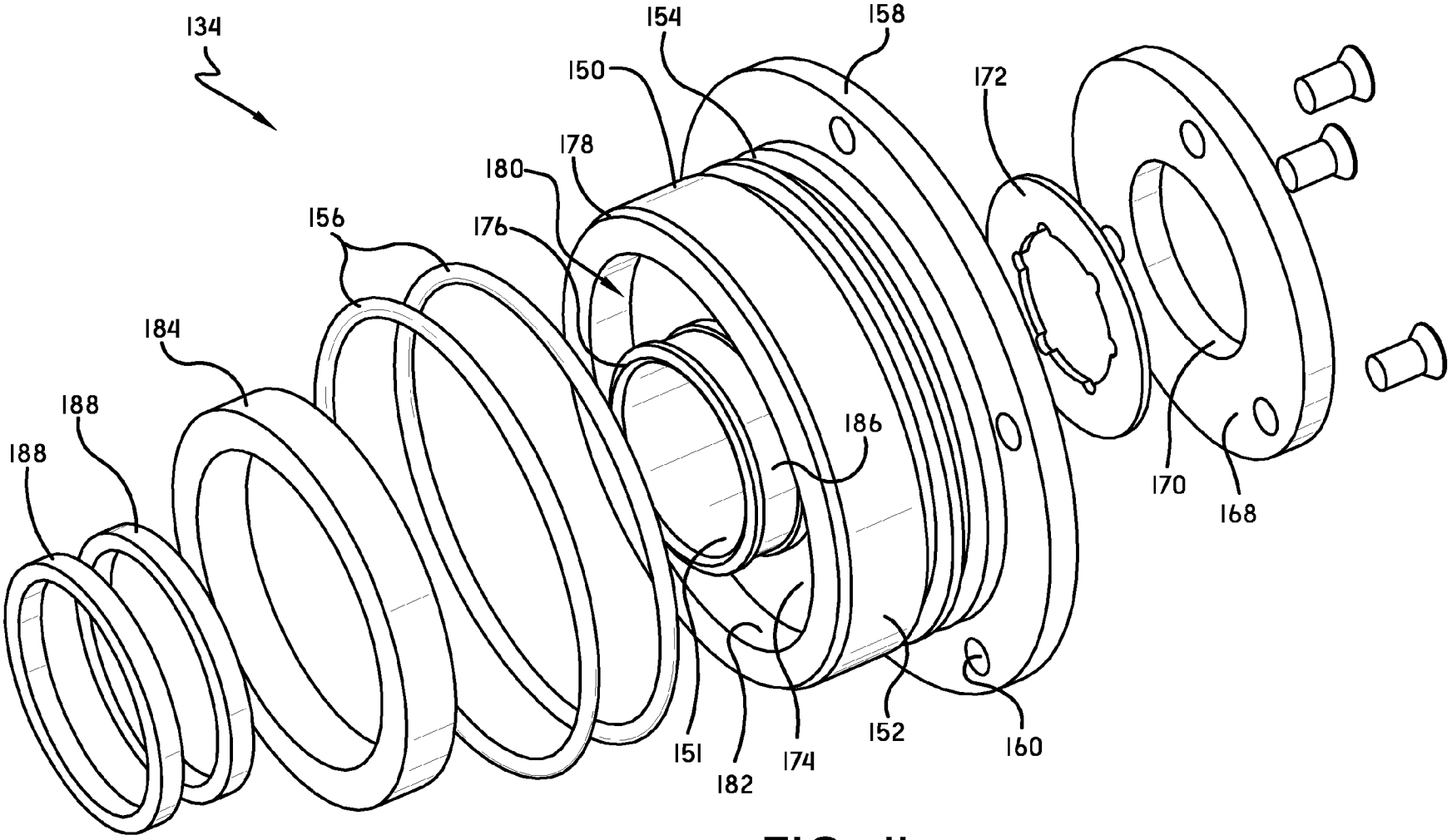
FIG. 11 is an exploded view of the inserts.
Figure 12:
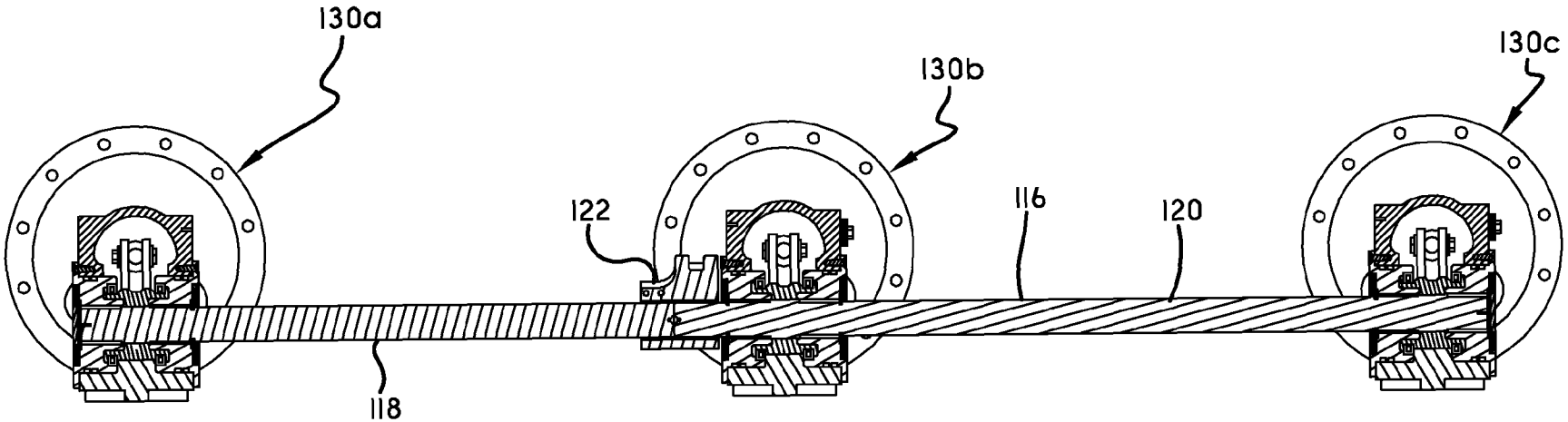
FIG. 12 a section view along line 12-12 of FIG. 6.

With reference now to FIGS. 11-13, insert 134 includes a generally cylindrical main body portion 150 defining a central, axially extending bore 151 and an outer circumferential surface 152 that is slightly smaller in diameter than the diameter of bore 142. Surface 152 includes a pair of spaced annular grooves 154 that receive seals 156 therein. Seals 156 engage the interior surface of bore 142 to prevent gas from entering or escaping the space therebetween.

A flange 158 is located proximate to seals 156 and is provided with bolt holes 160 that receive bolts 162 to secure insert 134 to housing 132. An axially exterior facing surface 164 includes an annular stepped portion 166 that is sized to receive a retaining plate 168. Retaining plate 168 includes a central bore 170 of approximately the same diameter as bore 151 of main body portion 150. As can be seen from FIGS. 11 and 13, when mounted to main body portion 150, retaining plate 168 secures an annular dust/contaminate seal 172 that extends radially inwardly and contacts transfer shaft assembly 116. In this manner, seal 172 prevents dust and other contaminates from entering the interior areas of bellcrank assembly 130.

An axially interior facing surface 174 includes an inner cylindrical projection 176 and an outer cylindrical projection 178. Projections 176 and 178 form an annular channel 180 therebetween. The radially inward facing surface 182 of outer cylindrical projection 178 is sized to carry and engage a bearing 184 which, as will be discussed later in greater detail, enables the low friction rotational movement of bellcrank 136. The radially outward facing surface 186 of inner cylindrical projection 176 is sized to carry a pair of gas seals 188 which, as will be discussed later in greater detail, will engage a surface on bellcrank 136 to form a generally airtight seal therebetween and prevent gasses and/or dielectric medium from entering or exiting the interior volume of pole assembly 102.

As discussed above, the only difference between the center bellcrank assembly 130*b* and the outer bellcrank assemblies 130*a* and 130*c*, lies in the differences in the bellcrank lever 136. Specifically, center bellcrank 136*b* has a first configuration and the two outer bellcrank assemblies 130*a* and 130*c* have bellcrank levers 136*a* and 136*c* having a second configuration. Though the configurations are different, most features are the same, and thus, like numerals will be used for like features.

Figure 15:
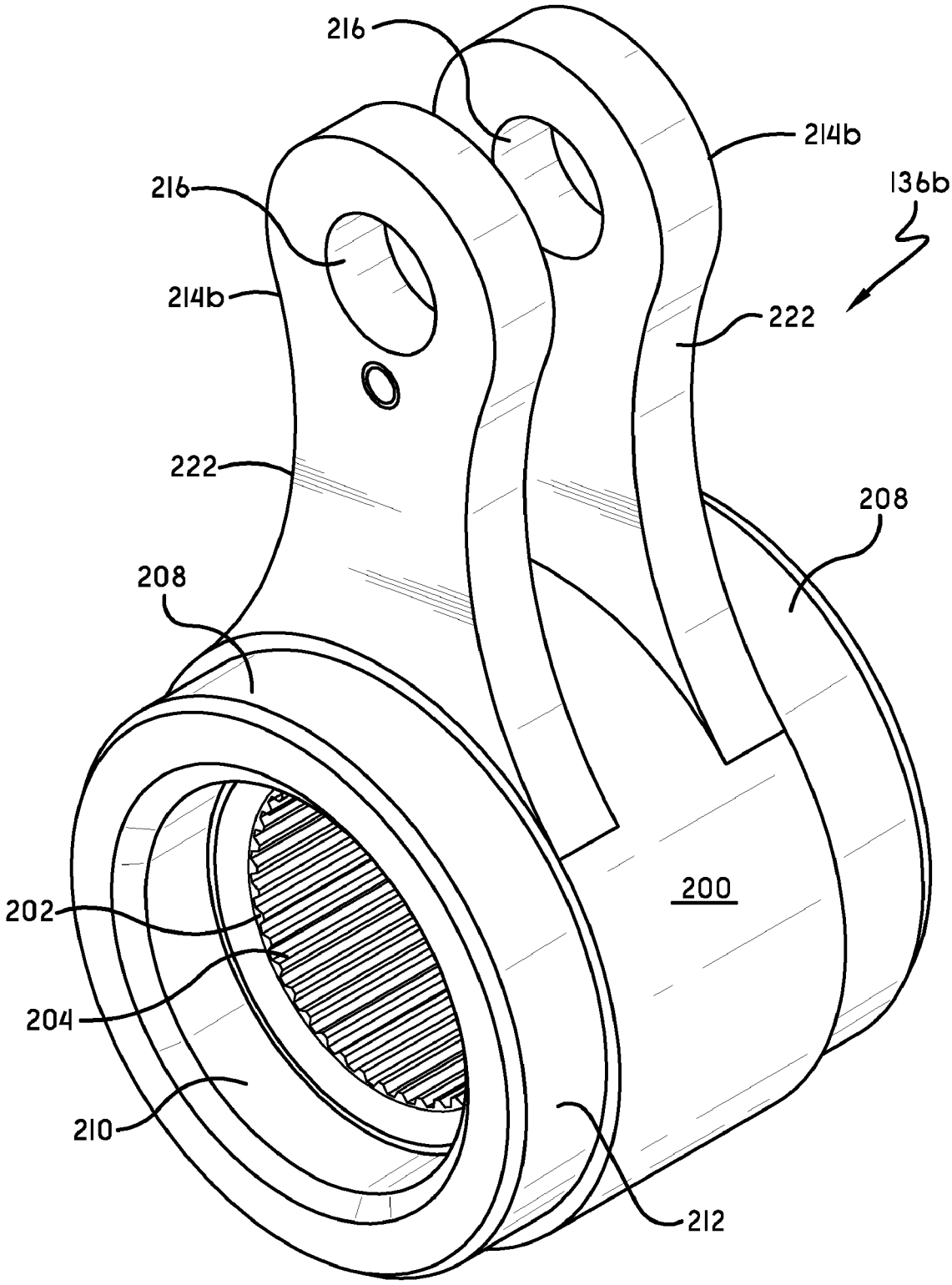
FIG. 15 is an isometric view of the center bellcrank lever.
Figure 16:
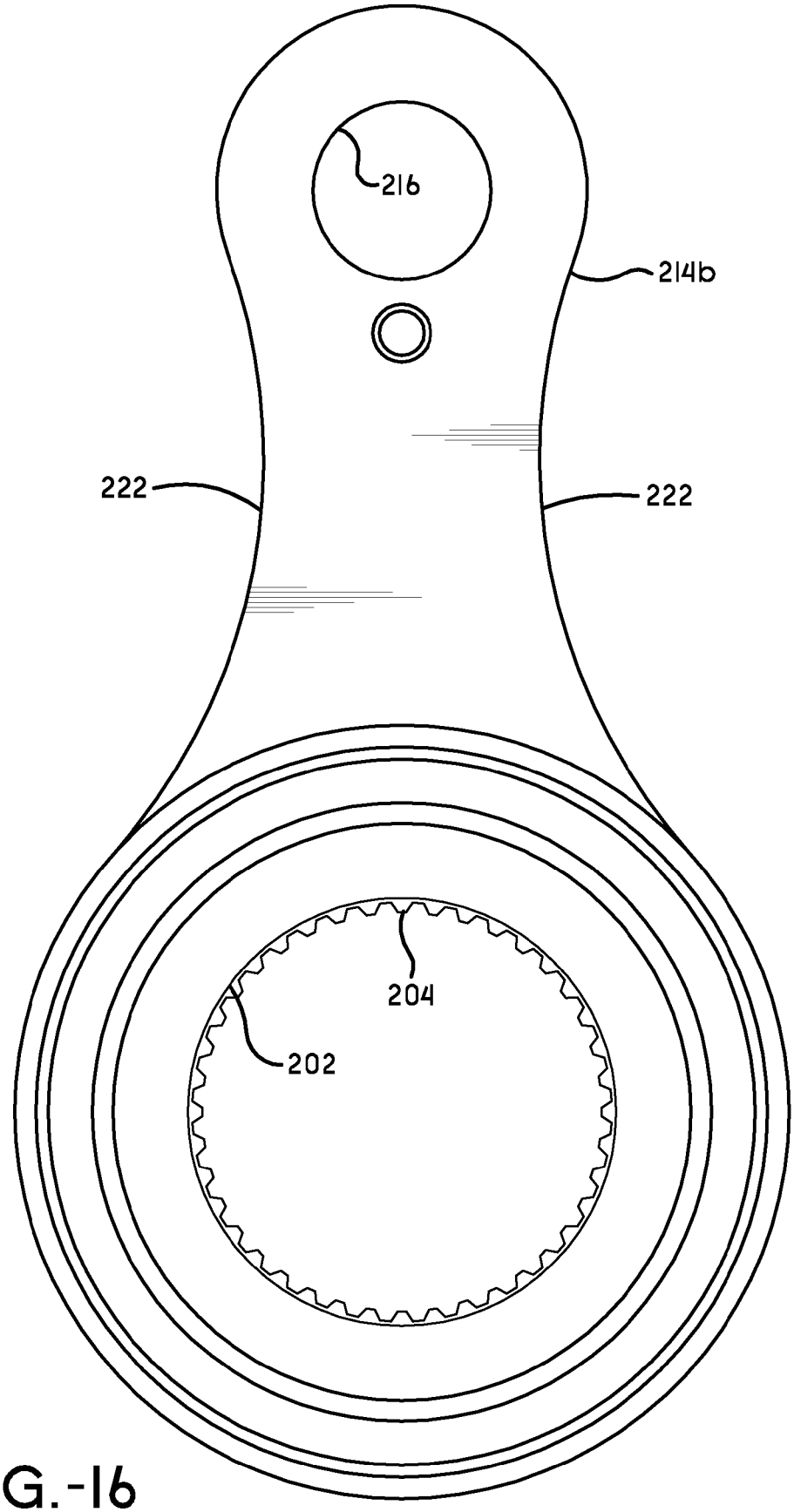
FIG. 16 is a side view of the center bellcrank lever.

With reference now to FIGS. 13, 15 and 16, center bellcrank 136*b* includes a central cylindrical body 200 having an interior bore 202 that is sized to receive transfer shaft assembly 116 therethrough. Bore 202 includes axially extending ribs 204 that are shaped to engage and rotationally couple to matching ribs 206 on transfer shaft assembly 116. In this manner, transfer shaft assembly 116 may be slidably received by bellcrank 136*b* and rotation of transfer shaft assembly 116 is transferred to bellcrank 136*b* through the intermeshing of ribs 204 and 206.

A circumferential projection 208 extends axially from each end of central body 200. A radially inward facing surface 210 has a larger diameter than bore 202 of central body 200. When assembled, the radially inward facing surface 210 faces, and is spaced from, the radially outward facing surface 186 of insert 134. As discussed above, gas seal 188 engages surfaces 186 and 210 to form an airtight seal therebetween. In this manner, the dielectric medium in pole 102 is maintained.

A radially outward facing surface 212 of projection 208 has a smaller diameter than central cylindrical body 200. When assembled, the radially outward facing surface 212 faces, and is spaced from, the radially inward facing surface 182 of insert 134. As discussed above, radially inward facing surface 182 carries bearing 184. Thus, bearing 184 is secured between surfaces 182 and 212 allowing relative rotational low friction movement between insert 134 and bellcrank lever 136*b*.

Bellcrank lever 136*b* further includes a pair of arms 214*b* that extend radially away from central body 200. Arms 214*b* are axially spaced and include a pair of apertures 216 at a location radially spaced from central body portion 200. Aperture 216 are adapted to receive a pin 218 therein, which pivotally couples arms 216 to a push rod 220 (see FIG. 10). Thus, it should be evident that rotation of transfer shaft assembly 116 causes rotation of bellcrank lever 136, which causes arms 214*b* to move in an arcing motion, thereby causing push rod 220 to move longitudinally inward or outward relative to pole assembly 102. Push rod 220 is mechanically interconnected to movable contact 24, thus, rotation of transfer shaft assembly 116 causes movable contact 24 to move longitudinally inward or outward to selectively engage or disengage from stationary contact 22.

Figure 17:
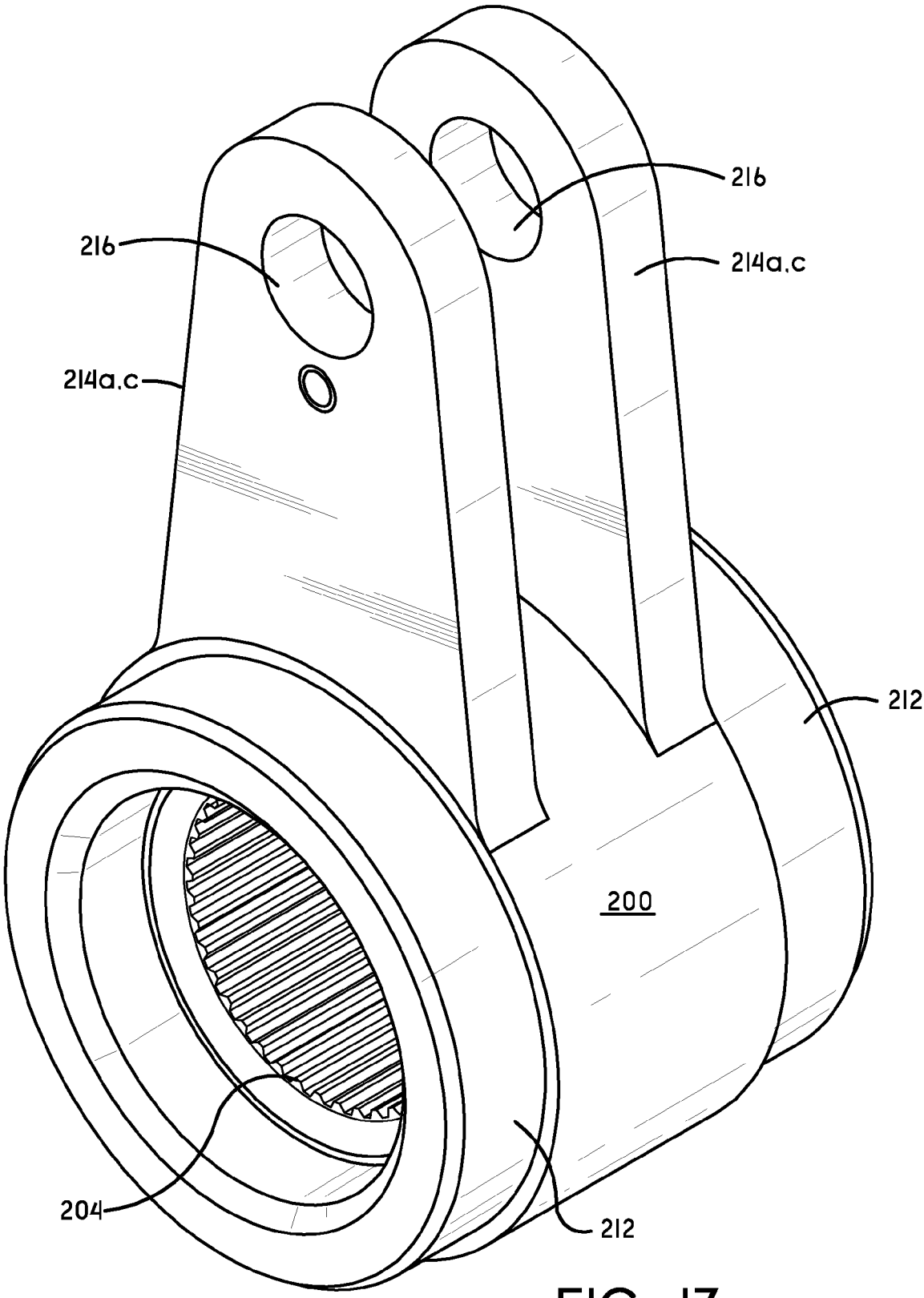
FIG. 17 is an isometric view of the outer bellcrank lever.
Figure 18:
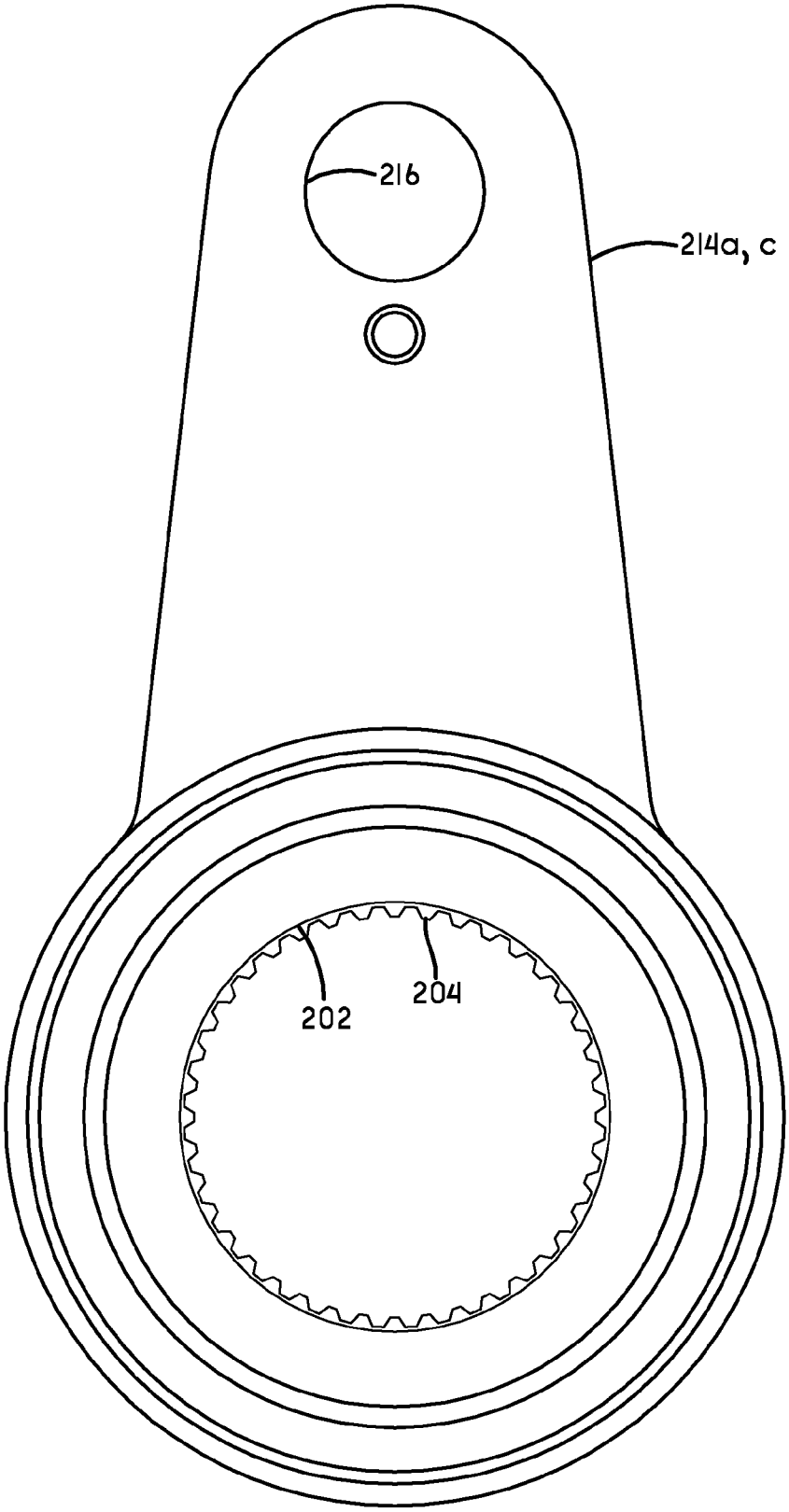
FIG. 18 is a side view of the center bellcrank lever.

The difference between the configuration of the outer bellcrank assemblies 130*a* and 130*c* and the center bellcrank assembly 130*b* lies in the respective configuration of arms 214*b*. With reference again to FIGS. 15 and 16, arms 214*b* of center bellcrank lever 136*b* include inwardly curved portions 222 in the portion spanning between central body 200 and apertures 216. With reference now to FIGS. 17 and 18, the bellcrank levers 136*a* and 136*c* of outer bellcrank assemblies 130*a* and 130*c* are substantially similar to the configuration of bellcrank lever 136*b*, with one exception. Arms 214*a,c* do not include curved portions 222. Instead, arms 214*a,c* are generally straight from central body 200 to apertures 216. Thus arms 214*a,c* have a larger cross-sectional size and are thus relatively more stiff (resistant to flexing) than arms 214*b*. In other words, because arms 214*b* of the center bellcrank lever 136*b* are relatively more narrow than arms 214*a,c* of outer bellcrank levers 136*a,c*, they are relatively more flexible than arms 214*a,c*.

It should be appreciated that the above disclosed configuration of arms 214 is just one embodiment of the present invention. Other shapes and geometries may be employed to tune the relative stiffness of each bellcrank lever to achieve optimal actuation synchronization between the three poles. Further, modification of relative stiffness may be accomplished using by different materials for each bellcrank lever (i.e. stiffer materials for the outer bellcrank lever and more flexible materials for the center bellcrank lever).

In this manner, the center bellcrank lever 136*b* is 'tuned' by configuring arms 214*b* to be relatively flexibile compared to the arms in the two outside phases. In other words, the interphase shafts are as torsionally stiff as possible and the center bellcrank lever arms 214*b* are weakened to introduce some flex. This configuration equalizes the 'stiffness' between the mechanism and the interrupter's driving lever at each phase.

By varying, or tuning the stiffness of the outer bellcranks relative to the center bellcrank, improved synchronization is achieved. The different bellcrank stiffness is needed to compensate for the flex that occurs in transfer shaft assembly 116. Specifically, when the actuating torque is applied to transfer shaft assembly 116 via sleeve 122, the transfer shaft assembly 116 will flex. The affect of the flexing transfer shaft assembly 116 increases as the axial distance from the force input increases. Thus, center bellcrank assembly 130*b* is relatively very close to the torque input at sleeve 122. Therefore the effect of flex of the transfer shaft assembly is minimized. However, outer bellcrank assemblies 130*a* and 130*c* are relatively further from the torque input at sleeve 122. Therefore, the effect of flex in the transfer shaft assembly 116 is relatively greater. In practical effect, if this imbalance is not corrected, the outer bellcranks 136*a* and 136*c* will lag slightly behind operation of the center bellcrank assembly 130*b*. By making the bellcrank arms of the outer bellcrank assemblies 130*a* and 130*c* slightly stiffer than the bellcrank arms of the center bellcrank assembly 130*b*, the flex in the transfer shaft assembly 116 is compensated for. In this manner each bellcrank assembly 130 may actuate their associated movable contact 24 with greater unity.

Figure 1:
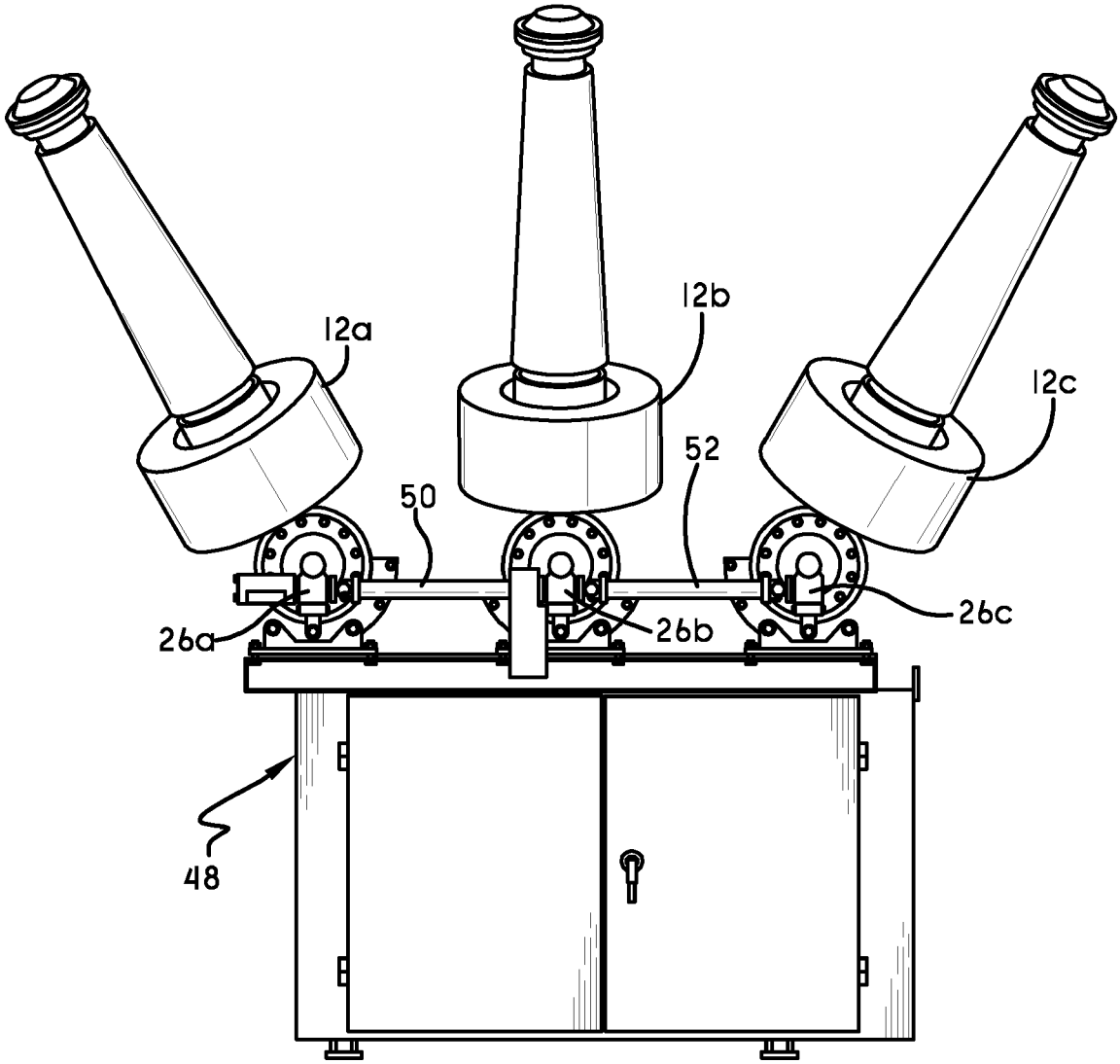
FIG.-1 PRIOR ART
FIG. 1 is a front view of a prior art breaker.
Figure 2:
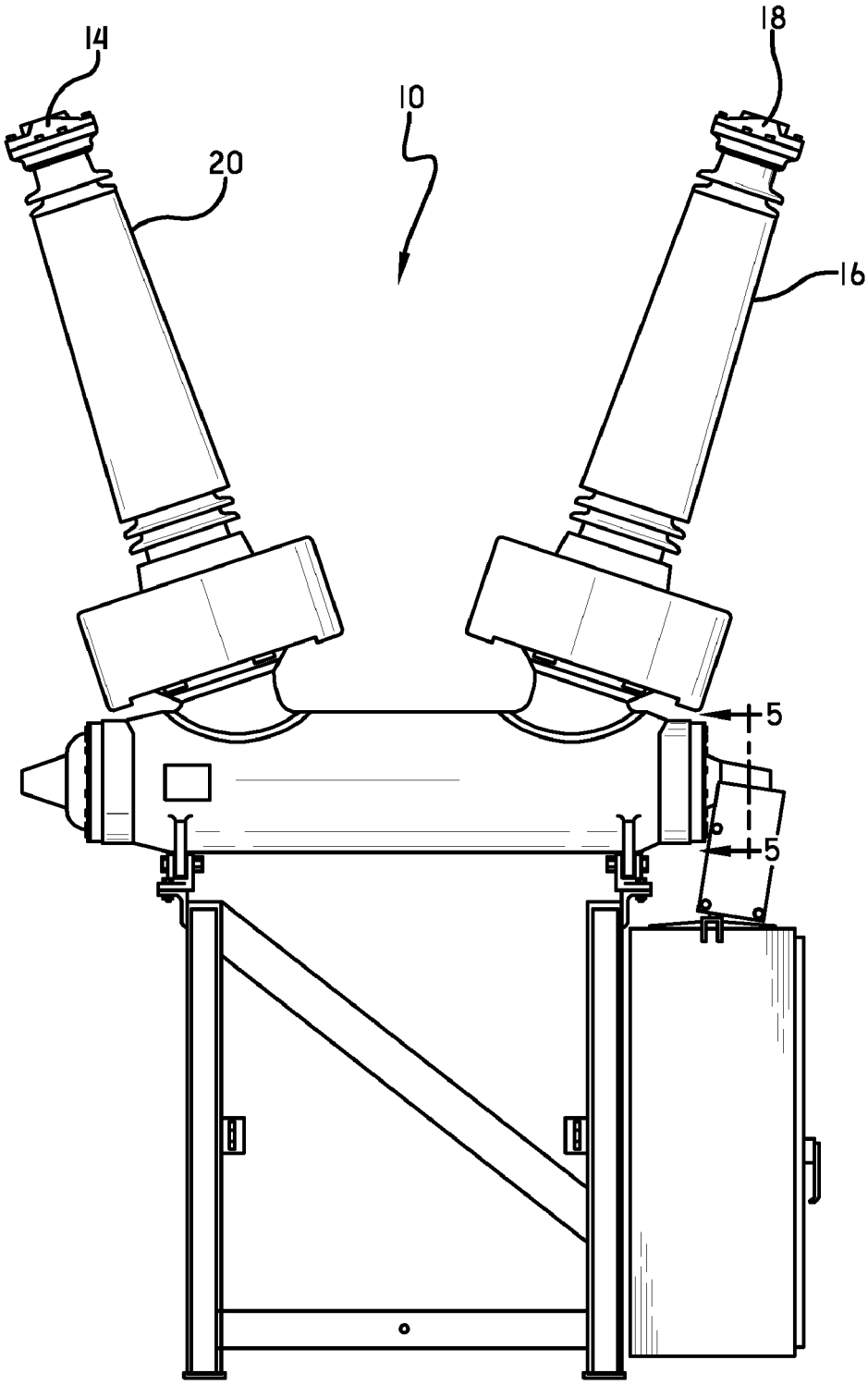
FIG.-2 PRIOR ART
FIG. 2 is a side view of a prior art breaker.
Figure 3:
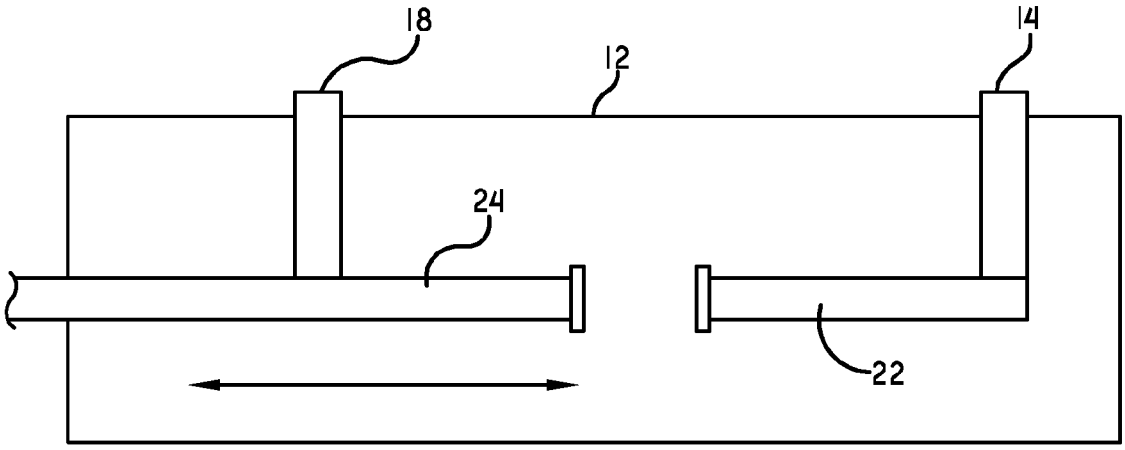
FIG.-3 PRIOR ART
FIG. 3 is a simplified schematic view of the interior of a prior art breaker pole wherein the electrical contacts are open.
Figure 4:
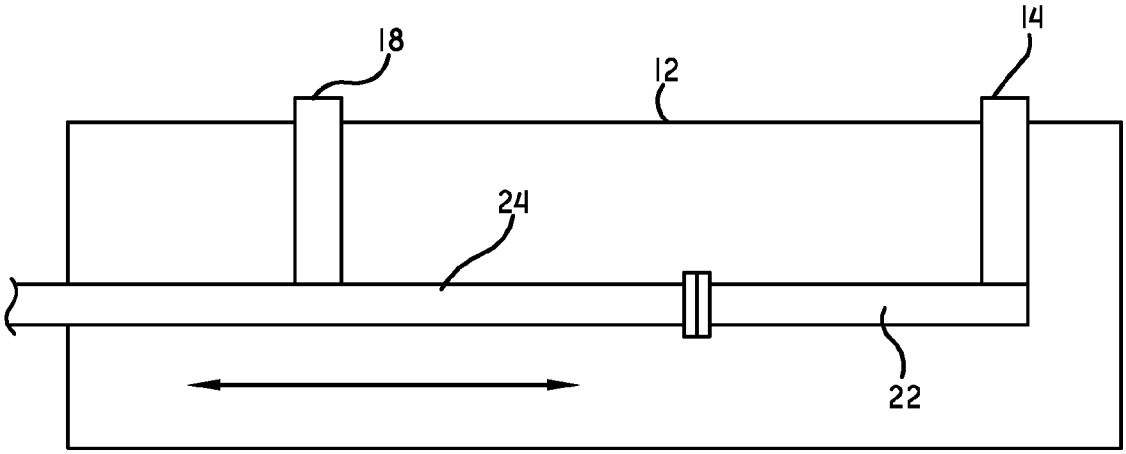
FIG.-4 PRIOR ART
FIG. 4 is a simplified schematic view of the interior of a prior art breaker pole wherein the electrical contacts are closed.
Figure 5:
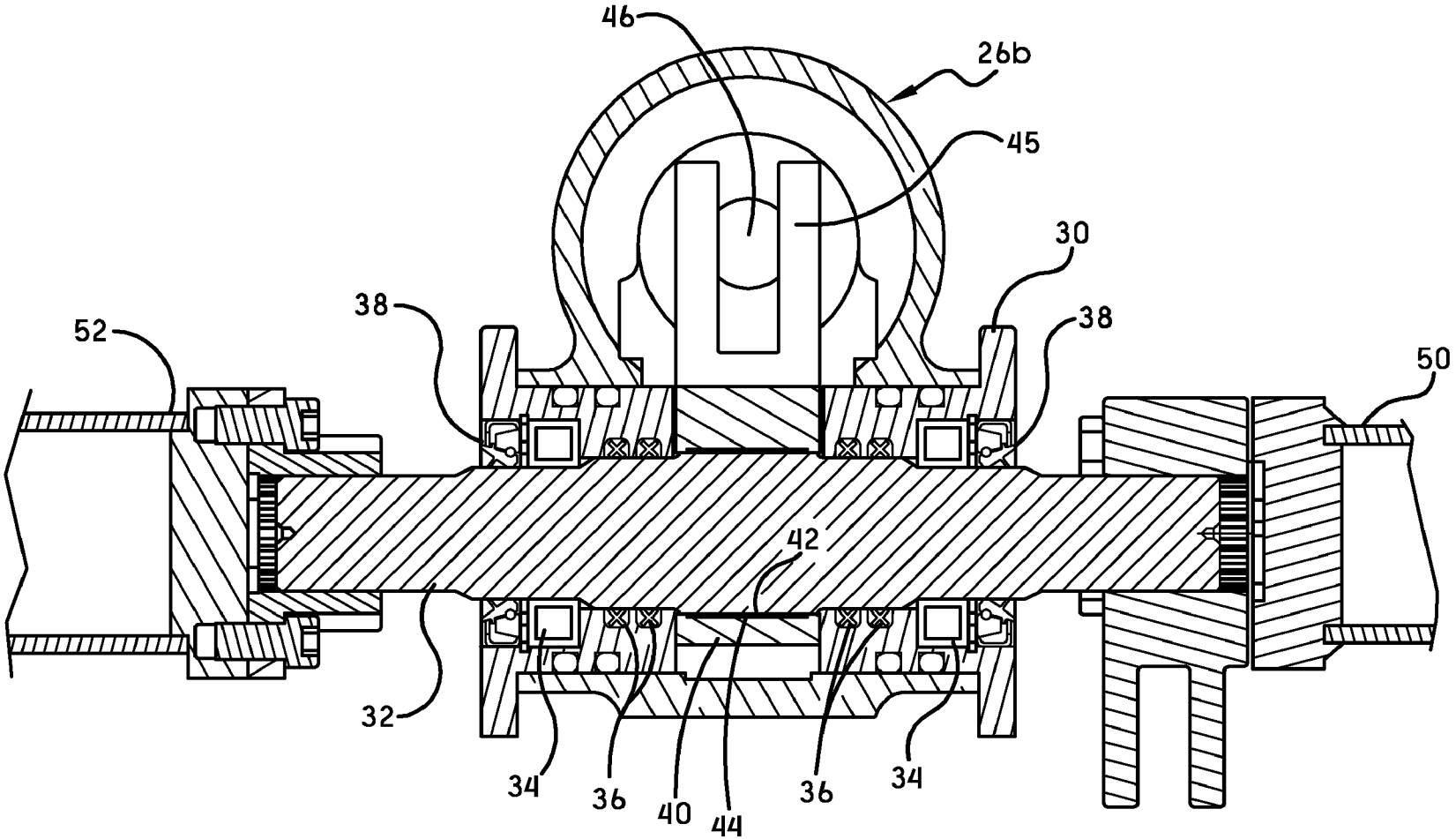
FIG.-5 PRIOR ART
FIG. 5 is a section view along line 5-5 of the prior art breaker shown in FIG. 2.

It has also been found that coupling points in a mechanical system are a source of motion and flex when torque is applied to the system (e.g. the spline/ribbed connections are meshed hand and therefore have a certain degree of slop). Thus, to improve synchronization, it is advantageous that the same number of coupling points be used between the input torque and each bellcrank 136. As can be seen from FIG. 12, only one coupling point (the area where ribs 206 of the transfer shaft assembly 116 intermesh with ribs 204 of each bellcrank 136) is interposed between the input torque (at sleeve 122) and each bellcrank lever 136. Because a uniform number of coupling points are interposed between each bellcrank lever 136 and sleeve 122, synchronization is improved. This is an improvement over the prior art methods (see FIG. 5) wherein, because each bellcrank assembly 26 includes a separate stub shaft 32, the number of coupling points is non-uniform between each bellcrank 40 and the input actuating torque.

The present invention also minimizes the overall number of coupling points in the system. Because the individual stub shafts 32 of the prior art designs is eliminated, fewer coupling points are necessary, thus reducing the overall variability of the breaker operation.

Still further, the present invention achieves a more stable motion system for the bellcrank lever 136 because the bearings 184 locate/support the bellcrank lever 136 directly, instead of the shaft as is shown in the prior art device. Additionally, the bellcrank lever 136 is axially located inside the bellcrank assembly 130 by the inner races of the bearings. In the previous design, the bellcrank lever 136 was axially located by the stationary bearing block which created a wear point. In this manner, the design of the present invention eliminates a potential wear-point in the bellcrank assembly 130.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

I claim:

1. A circuit breaker comprising a plurality of pole assemblies, each said pole assembly including a movable contact and a stationary contact;

a plurality of bellcrank assemblies, each associated with one of said pole assemblies, each said bellcrank assembly including a bellcrank lever including a cylindrical body and at least one radially extending arm, said radially extending arm being mechanically interrelated with said movable contact so that rotation of said bellcrank lever selectively causes said movable contact to engage or disengage said stationary contact; and wherein at least one of said bellcrank lever radially extending arms is relatively more flexible than another of said bellcrank lever radially extending arms.

2. A circuit breaker according to claim 1 wherein said plurality of bellcrank assemblies comprises a center bellcrank assembly and a first outer bellcrank assembly and a second outer bellcrank assembly being position on opposed sides of said center bellcrank assembly.

3. A circuit breaker according to claim 2 wherein said radially extending arm of said bellcrank lever of said central bellcrank assembly is relatively more flexible than said radially extending arm of said bellcrank lever of said first and said second outer bellcrank assemblies.

4. A circuit breaker according to claim 1 wherein said relatively more flexible radially extending arm is thinner than said another of said bellcrank lever radially extending arms.

5. A circuit breaker according to claim 1 wherein said another of said bellcrank lever radially extending arms is composed of a relatively stiffer material than said relatively more flexible radially extending arm.

6. A circuit breaker according to claim 3 further comprising a transfer shaft, wherein each said bellcrank lever includes a central bore and said transfer shaft extends between first and second outer bellcrank assemblies and said central bellcrank assembly and is received in said bore of each said bellcrank lever.

7. A circuit breaker according to claim 6 wherein each said bellcrank lever includes a meshing feature and said transfer shaft includes matching meshing features so that said transfer shaft is rotationally coupled to each said bellcrank lever.

8. A circuit breaker according to claim 7 further comprising a sleeve coupled to said transfer shaft, said sleeve being adapted to transmit an actuating force to said transfer shaft.

9. A circuit breaker according to claim 6 wherein said transfer shaft comprises a first and a second axially aligned transfer shafts that are coupled together proximate to said central bellcrank assembly.

10. A bellcrank arrangement for a circuit breaker having an actuator and a plurality of poles, each said pole having movable and stationary contacts, said bellcrank arrangement comprising:

a central bellcrank assembly and a first and second outer bellcrank assemblies positioned on opposed sides of said central bellcrank assembly, each said bellcrank assembly being associated with one of the poles and including a bellcrank lever having a cylindrical body portion having an axially extending bore, said bellcrank lever including at least one lever arm extending radially away from said cylindrical body portion;

a transfer shaft being rotatively coupled to, and received in, said axially extending bore of said bellcrank lever of each of said central, said first and said second bellcrank assemblies; and wherein the movable contact of each said pole is mechanically interconnected to said lever arm of the associated bellcrank assembly so that rotation of said bellcrank lever causes the moveable contact to selectively engage or disengage from the stationary contact.

11. The bellcrank arrangement of claim 10 wherein said lever arm of said central bellcrank assembly is relatively more flexible than said lever arms in said first and said second bellcrank assemblies.

12. The bellcrank arrangement of claim 10 wherein each said bellcrank assembly further includes a housing having a central bore and an insert secured in each end of said housing central bore.

13. The bellcrank arrangement of claim 10 further comprising a sleeve coupled to said transfer shaft, said sleeve being adapted to transmit an actuating force to said transfer shaft.

14. The bellcrank arrangement according to claim 12 wherein said transfer shaft comprises a first and a second axially aligned transfer shafts that are coupled together proximate to said central bellcrank assembly.

15. The bellcrank arrangement according to claim 12 wherein each said insert includes a outer cylindrical projec tion and an inner cylindrical projection having a diameter smaller than said outer cylindrical projection, said outer cylindrical projection including a radially inner facing surface and said inner cylindrical projection having a radially outer facing surface, each said bellcrank lever including a circumferential projection at each end of said cylindrical body, wherein said circumferential projection of said bellcrank lever is received between said outer and said inner cylindrical projections.

16. The bellcrank arrangement according to claim 15 wherein a bearing is secured between each said outer cylindrical projection and said circumferential projection.

17. The bellcrank arrangement according to claim 15 wherein a gas seal is secured between each said inner cylindrical projection and said circumferential projection.

* * * * *